US011149764B2

(12) United States Patent
Rodrigues Da Costa

(10) Patent No.: US 11,149,764 B2
(45) Date of Patent: Oct. 19, 2021

(54) HYDRAULIC CYLINDER AND FACILITY IMPLEMENTING AT LEAST ONE SUCH HYDRAULIC CYLINDER

(71) Applicant: Hydraulique Production Systems, Ennery (FR)

(72) Inventor: Jose Rodrigues Da Costa, Ennery (FR)

(73) Assignee: Hydraulique Production Systems, Ennery (FR)

( * ) Notice: Subject to any disclaimer, the term of this patent is extended or adjusted under 35 U.S.C. 154(b) by 0 days.

(21) Appl. No.: 16/630,897

(22) PCT Filed: Jul. 3, 2018

(86) PCT No.: PCT/EP2018/067885
§ 371 (c)(1),
(2) Date: Jan. 14, 2020

(87) PCT Pub. No.: WO2019/011714
PCT Pub. Date: Jan. 17, 2019

(65) Prior Publication Data

US 2020/0232486 A1 Jul. 23, 2020

(30) Foreign Application Priority Data

Jul. 14, 2017 (EP) ..... 17181477

(51) Int. Cl.
*F15B 15/28* (2006.01)

(52) U.S. Cl.
CPC ..... *F15B 15/2861* (2013.01); *F15B 15/2892* (2013.01)

(58) Field of Classification Search
CPC ..... F15B 15/2861; F15B 15/2892
See application file for complete search history.

(56) References Cited

U.S. PATENT DOCUMENTS 7,023,199 B2 * 4/2006 Blubaugh ..... F15B 15/2815 324/207.13
7,855,551 B2 * 12/2010 Steinich ..... F15B 15/2861 324/207.13

FOREIGN PATENT DOCUMENTS

DE 202005006795 U1 7/2005
DE 202006012815 U1 12/2007
(Continued)

OTHER PUBLICATIONS

Aug. 9, 2018, International Search Report of PCT/EP2018/867885.

*Primary Examiner* — F Daniel Lopez
(74) *Attorney, Agent, or Firm* — Banner & Witcoff, Ltd.

(57) ABSTRACT

The invention relates to a hydraulic cylinder comprising a body (1) having a wall (3) that defines a cylindrical cavity (2), with a cylindrical cavity axis (X), in which a piston (4) is movably mounted, said piston (4) separating said cylindrical cavity (2) into two tight chambers (5, 6) that are isolated from each other, the wall (3) of the body comprising at least two passages (7, 8) for introducing or discharging a fluid into each of said two chambers (5, 6). The cylinder also comprises two end walls (17, 18) and a rigid rod (32) which is secured to the piston (4) and coaxial with the cylindrical cavity (2), said rod (32) passing through a passage opening (20) provided in one of the two end walls (17, 18). The cylinder is characterised in that it comprises a position sensor (38) comprising a sensor head (39), a sensor rod (40) which is secured to the sensor head (39) and around which a magnet (41) is fitted, and a connector (42) connected to said sensor head (39).

13 Claims, 5 Drawing Sheets

(56) References Cited

FOREIGN PATENT DOCUMENTS

| | | |
|---|---|---|
| EP | 1435462 A1 | 7/2004 |
| FR | 1439211 A | 5/1966 |

* cited by examiner

HYDRAULIC CYLINDER AND FACILITY IMPLEMENTING AT LEAST ONE SUCH HYDRAULIC CYLINDER

The invention relates to an improvement to a hydraulic cylinder, and to a facility implementing one or more cylinders according to the invention.

The facilities that implement molds for the manufacturing of parts by injection-molding of material are often bulky, and their upkeep may sometimes be complicated and expensive: when a mold is taken out of service it sometimes has to be dismantled and the parts that the mold comprises have to be repaired. Mold down-time leads to a loss of income and to production delays. Handling a mold sometimes requires the intervention of bulky devices, such as traveling cranes, which requires the full attention of one or more operators in order to be operated correctly.

It is therefore important to be able to anticipate certain mold breakdowns in order to be able to make the necessary adjustments or replacements before the mold has to be taken off-line completely.

Control modules able to indicate a problem when the problem occurs exist. However, there is no facility that makes it possible to make automatic adjustments in order to anticipate certain breakdowns or which allow the breakdowns to be anticipated directly.

In molds into which material is injected in order to create molded parts, cylinders are implemented notably for demolding the parts produced before these parts are grasped and extracted from the mold.

The cylinders are often subject to breakdowns because their rod is highly stressed and sometimes breaks. Sometimes, the cylinders exhibit leaks and are no longer able to perform their function of ejecting the molded parts.

The invention seeks to propose a new cylinder that makes it possible to anticipate a potential breakage or a potential sealing problem, that could render it inoperative.

The hydraulic cylinder according to the invention comprises:

- a body comprising a wall delimiting a cylindrical housing having a cylindrical housing axis, in which a piston is mounted with the ability to move with a travel, said piston dividing said cylindrical housing into two chambers which are fluidtight and isolated with respect to one another,
- the wall of the body comprising at least two passages for introducing a fluid into or removing a fluid from each of the two said chambers,
- two end walls, each end wall closing in fluidtight fashion one end of said cylindrical housing,
- a rigid rod, secured to the piston and coaxial with the cylindrical housing, said rod passing through a passage opening formed in one of the two end walls.

The cylinder according to the invention is notable:

- in that it comprises a position sensor comprising a sensor head, a sensor rod which is secured to the sensor head and around which a magnet is push-fitted, and a connector connected to said sensor head,
- and in that the position sensor is arranged in the cylinder as follows:
  - the sensor head is enclosed in a fluidtight element internal to said body, said fluidtight element forming an end stop for said piston;
  - said sensor rod is at least partially inserted in said rigid rod of said hydraulic cylinder,
  - and the magnet is enclosed in said piston.

Produced in this way, the cylinder is a smart cylinder because it is capable of transmitting information specific to its operation in real time to an external module capable of processing the data and transmitting them to an operator, so as to prevent a potential problem that could lead to a mold having a lengthy down-time.

The cylinder according to the invention may also comprise the following features, considered separately or in combination:

- said connector is at least partially enclosed in a second fluidtight closure piece which is fixed at least partially to an end wall of the cylinder, and the second fluidtight closure piece is adjacent to the fluidtight element that accommodates the sensor head, so as to allow the connector to be connected to the sensor head;
  - the sensor head is partially accommodated in the second fluidtight closure piece:
  - the second fluidtight closure piece comprises a chamber positioned between the sensor head and the connector, said chamber being able to accommodate the connection pieces that connect the sensor head to said connector.

The invention also relates to a facility that implements one or more cylinders according to the invention.

More particularly, the invention is aimed at a facility for manufacturing at least one part injection-molded in at least one mold, said facility comprising:

- at least one mold equipped with at least one cylinder, notably for at least partially ejecting a part molded in said mold,
- at least one press notably for opening and closing said mold, said press comprising at least one control module for controlling the operation of said mold.

The facility according to the invention is notable in that said at least one cylinder is a hydraulic cylinder according to the invention, as defined hereinabove, and said at least one hydraulic cylinder communicates with said control module of the press, transmitting to it information specific to its operational status.

According to the invention, the press may be equipped with at least one electrically-operated valve connected to said supply circuit supplying fluid to a hydraulic cylinder, and said control module may transmit operating instructions to said electrically-operated valve, notably in response to the information transmitted by said hydraulic cylinder.

Again according to the invention, said press may comprise at least one pressure sensor positioned downstream of the electrically-operated valve, and said at least one pressure sensor may communicate with said control module.

Again according to the invention, said mold may comprise more than two hydraulic cylinders, the press may comprise at least one bored unit comprising at least two electrically-operated valves and at least two pressure sensors, each pressure sensor being associated with one electrically-operated valve, and each electrically-operated valve being associated with one hydraulic cylinder.

Again according to the invention, said control module may be associated with a communication interface that said facility comprises, said control module being able to transmit information to said communication interface, said information being transcribed to a screen intended for an operator.

Again according to the invention, said communication interface may be able to receive and to transmit instructions to the control module in response to information transmitted by an operator.

Finally, the invention relates to a method for implementing the aforementioned facility, which is notable in that it comprises the following steps:

a) the sensor of the hydraulic cylinder generates position information
b) said position information is transmitted to said control module,
c) said control module compares said position information with reference position information
d) said control module generates a hydraulic-cylinder status response,
e) said control module transmits said hydraulic-cylinder status response to a communication interface
f) said communication interface transcribes said hydraulic-cylinder status response so that it is intelligible to an operator.

The method may, in parallel with step e), implement the following step:

g) said control module transmits an operating instruction to said electrically-operated valve.

The method may also comprise the following steps:

h) said at least one pressure sensor generates pressure information
i) said at least one pressure sensor transmits said pressure information to said control module
j) said control module compares said pressure information with a pressure threshold value and generates a pressure-status response.
k) Said control module transmits said pressure-status response to a communication interface
l) said communication interface transcribes said pressure-status response so that it is intelligible to an operator.

The method may also implement the following step:

m) said control module transmits an operating instruction to said electrically-operated valve.

According to the invention, the transcribing of said hydraulic-cylinder status response or of said pressure status response by said communication interface may be written information printed on a screen and/or an audible signal emitted by said interface and/or an element that displays on a screen in a predetermined color.

The following description discloses the invention in a manner sufficiently clear and complete for it to be able to be carried out and is in addition accompanied by drawings in which.

In the description which follows, the terms "lower", "upper", "top", "bottom" etc., are used with reference to the drawings for greater ease of understanding. They should not be interpreted as limiting the scope of the invention.

Firstly, reference will be made to FIGS. 1 to 4, for a detailed description of an example of a hydraulic cylinder according to the invention.

Secondly, reference will be made to FIGS. 5 and 6 to describe a facility according to the invention, and a method according to the invention for implementing the facility described.

Figure 1:
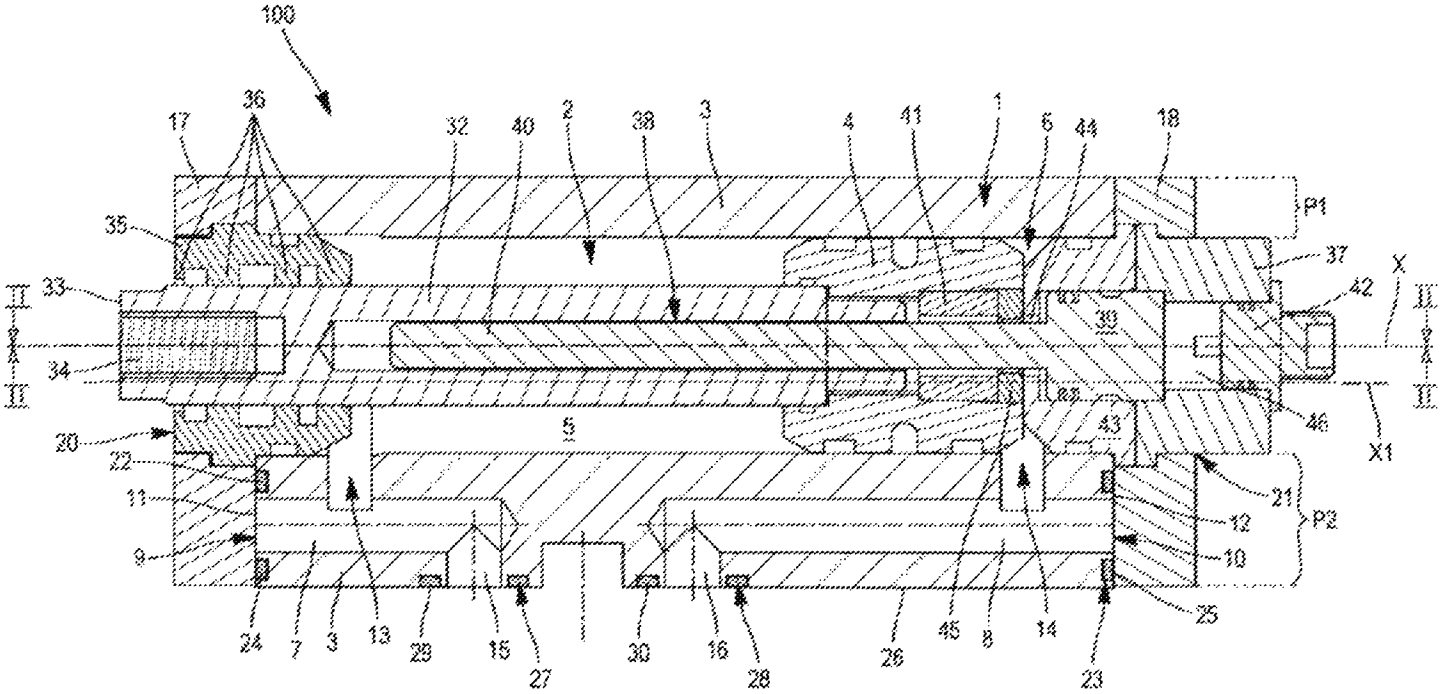
FIG. 1 is a first view in section of a hydraulic cylinder according to the invention.

FIG. 1 shows a cylinder according to the invention, comprising a body 1 of parallelepipedal overall exterior shape. The body 1 comprises a cylindrical internal housing 2. A wall 3 delimits the cylindrical internal housing and has a different wall thickness at different points on the body 1. This difference in wall thickness is due to the fact that the cylindrical housing, of axis X, is produced eccentrically with respect to the axis X1 of the body 1 of the cylinder.

Figure 3:
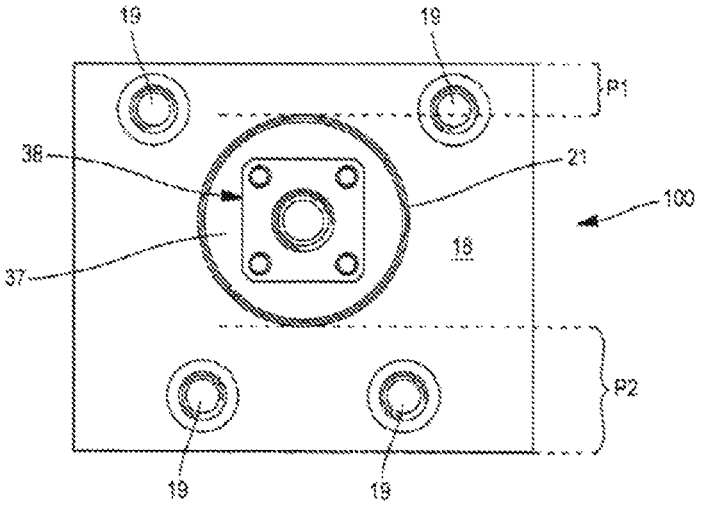
FIG. 3 is a first side view of the cylinder shown in FIGS. 1 and 2

It will also be noticed from FIGS. 1 and 3 that the upper part P1 of the body 1 has a wall 3 that is not as thick as the lower part P2 of the body 1.

The explanations as to the benefit of having a difference in wall thickness will be set out hereinafter.

Figure 2:
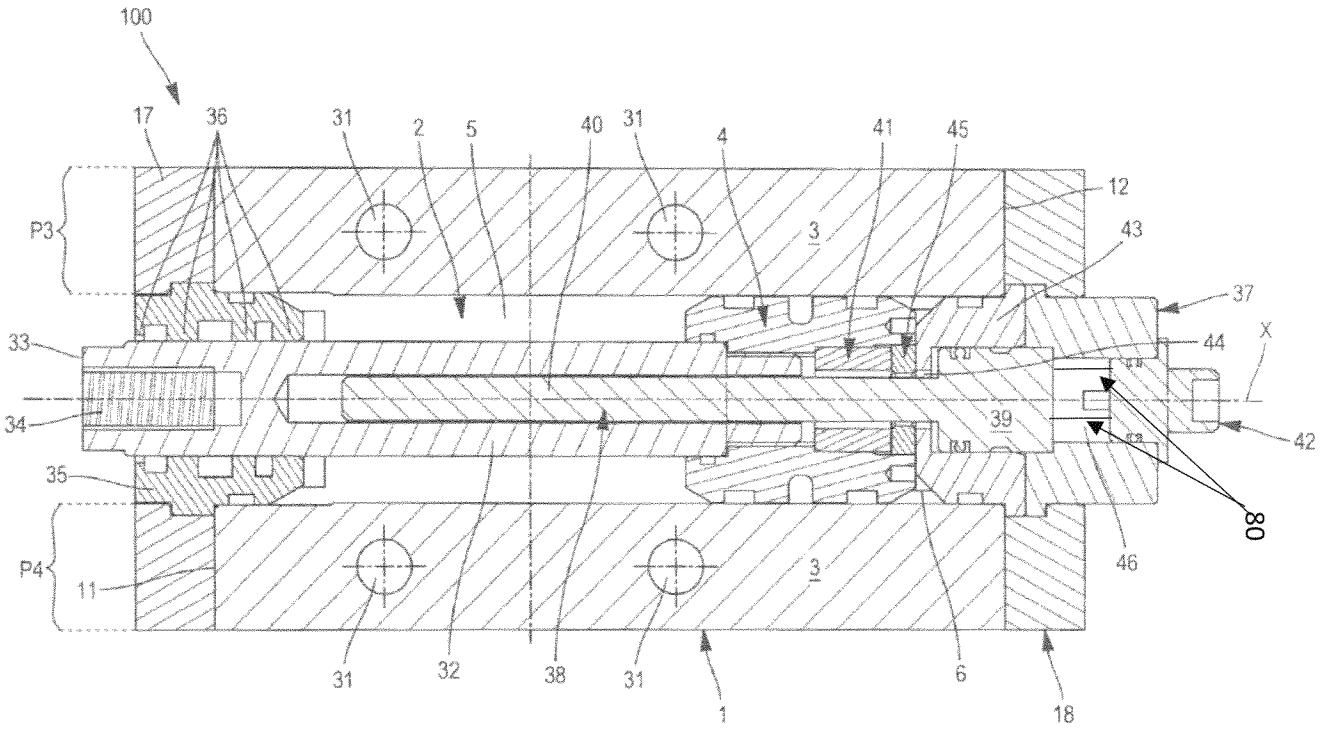
FIG. 2 is a view in section, on the plane II-II, of the cylinder shown in FIG. 1.
Figure 4:
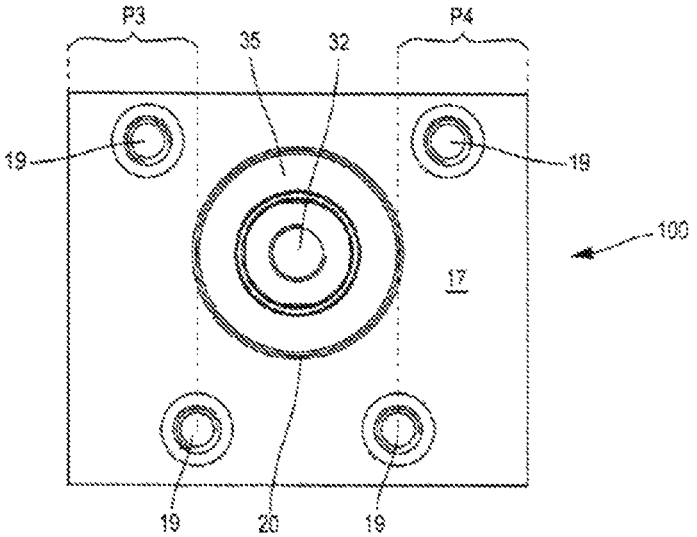
FIG. 4 is a second side view of the cylinder shown in FIGS. 1 and 2.

FIGS. 2 and 4 show that the wall has the same thickness in the lateral parts P3 and P4 of the body (as this body is positioned in the figures).

The internal housing 2 comprises a piston. The piston 4 is mounted with the ability to move with a travel in the housing 2 under the effect of pressures exerted on either side of the piston by the introduction of fluid to either side of the piston in the housing.

The piston 4 acts as a fluidtight seal against the internal surface of the wall of the housing 2, so that it defines two internal chambers 5 and 6 which are fluidtight and isolated with respect to one another.

In order to supply the chambers 5 and 6 with fluid and allow the piston 4 its travel, longitudinal passages 7 and 8 have been made in the thickness of the part P2. The passages 7 and 8 have a longitudinal portion the axis of which is parallel to the axis X of the cylindrical housing 2.

The inlet 9 or 10 of each of the passages 7 and 8, respectively, is situated at one end of the body 1, on opposite edges 11 and 12 of the body 1.

The passages 7 and 8 each comprise an elbowed portion so as to have an outlet, 13 and 14 respectively, that opens respectively into each of the chambers 5 and 6.

Produced in this way, the passages 7 and 8 allow a fluid to be introduced into or removed from each of the chambers 5 and 6 respectively.

In order to supply the passages 7 and 8 with fluid laterally with respect to the body 1, two radial drillings 15 and 16 are made through the wall of the body, in the thickest part P2 comprising the two longitudinal passages 7 and 8. These radial drillings 15 and 16 are visible in FIG. 1 only. They are made radially in the wall 3 of the body and each laterally connect the outside of the body 1 to a longitudinal passage: the radial drilling 15 connects the outside of the body 1 to the longitudinal passage 7, and the radial drilling 16 connects the outside of the body 1 to the longitudinal passage 8.

The inlets 9 and 10 to the longitudinal passages are blocked off as follows:

two end walls 17 and 18, respectively to the left and to the right of the body 1 in FIGS. 1 and 2, are fixed by screwing 19 into the thickness of the wall 1.

The end walls 17 and 18 are rectangular in shape and have essentially the same cross-sectional shape as the body 1.

Each of the end walls 17 and 18 comprises a through-opening 20 and 21, respectively, the utility of which will be explained hereinafter.

In order to provide fluidtight closure of the inlets 9 and 10, an annular groove 22 or 23 is made in the wall thickness, around each of the inlets 9 and 10, in the edges 11 and 12 of the body 1. In addition, an o-ring seal 24 or 25 is placed in each of the grooves 22 or 23 respectively, and is compressed against the bottom of the grooves 22 or 23 and the end walls 17 or 18. In this way, the inlets 9 and 10 are sealed off.

Sealing between the surface of a mold (the mold is not depicted) and the surface 26 of the body of the cylinder having the radial drillings 15 and 16 is achieved in the same way:

the radial drillings 15 and 16 have inlets which are situated on the surface 26 of the body 1 of the cylinder.

Each of the inlets of the radial drillings 15 and 16 is surrounded by a respective groove 27 and 28, and each groove 27 and 28 houses a respective o-ring seal 29 and 30. Sealing is achieved by fixing the cylinder to the surface of the mold, pressing the surface 26 of the cylinder against the surface of the mold for example by screwing, which compresses the seals 29 and 30, providing sealing.

Attachment of the cylinder is achieved by screwing through through-holes 31 formed in the body 1 of the cylinder through the wall 3 and shown in FIG. 2.

It will be appreciated from the foregoing description how the inlets 9 and 10 of the longitudinal passages 7 and 8 have been closed off and how sealing is ensured around each of the inlets 9 and 10. Finally, it will be appreciated how sealing is also ensured around the inlets of the radial drillings 15 and 16 used for circulating fluid between the inside of the cylinder and the outside of the cylinder.

As is known per se, the cylinder comprises a rigid rod 32 secured to the piston 4 and coaxial with the internal cylindrical housing 2.

This rigid rod 32 exits and enters the body 1 of the cylinder, according to the motion of the piston, and allows objects placed against its free end 33 to be moved.

The free end of the rigid rod 33 may comprise a tapped blind hole 34 into which to fix an element, for example.

In order notably to seal off the cylindrical internal housing 2, a first fluidtight closure piece 35 closes off the opening 20 of the end wall 17 of the cylinder.

The rigid rod 32 passes through the first fluidtight closure piece 35. The rod 32 is guided axially through the first fluidtight closure piece 35 by a series of several internal rings 36 of the first fluidtight closure piece 35, the rings being projecting and distributed over the entire length of the fluidtight closure piece 35.

It should also be noted that the first fluidtight closure piece 35 bears at least partially against the internal wall of the cylindrical housing 2 (see FIGS. 1 and 2).

At the opposite end of the body 1 of the cylinder, a second fluidtight closure piece 37 closes the opening 21 formed in the end wall 18, which is the opposite end wall to the end wall 17.

The cylinder according to the invention, produced in this way, is fluidtight and performs properly.

The objective underlying the invention is to equip the cylinder with means that make it possible to know its status, and more particularly the position of the rod and of the piston in the internal cylindrical housing, precisely: in this way, the cylinder according to the invention is able to supply elements specific to its operational status.

In order to do this, the cylinder comprises a position sensor able to deliver information regarding the position of the rod 32 or the piston 4 in the cylindrical internal housing 2.

The position sensor 38 comprises a sensor head 39, secured to a sensor rod 40 around which a magnet 41 is placed (push-fitted). The position sensor 38 also comprises a connector 42 connected to the sensor head 39.

The magnet 41 is push-fitted around the rod 40 in such a way as to be able to travel along the rod 40.

According to the magnetic field generated by the magnet 41, the sensor head identifies it position on the rod 40: it is in this way that the sensor generates position information.

According to the invention, the various elements that the sensor comprises are arranged in the cylinder as follows:

the sensor head 39 is partially enclosed in an internal element 43 of the body 1 of the cylinder. In the context of this embodiment, the internal element 43 being fluidtight and fixed in the cylindrical housing 2 of the body of the cylinder. In addition, the internal element 43 forms an end stop for the piston 4 of the cylinder.

The sensor rod 40, secured to the sensor head 39, protrudes from the internal element 43 via an opening 44 formed in the internal element 43.

The sensor rod 40 passes through the piston 4 and is at least partially accommodated in the rod 32 of the cylinder according to the invention.

The magnet 41, push-fitted around the sensor rod 40, is accommodated in the piston and fixed thereto by means of a nut 45. Thus, when the piston 4 moves, the magnet 41 is also moved. It is in this way that the sensor is able to know precisely the position of the piston in the internal housing 2. The stroke of the piston can thus be checked.

The connector 42 is connected to the sensor head 39 by any known means: the connector 42 receives the information that the sensor head 39 generates (notably regarding the stroke of the cylinder) and comprises a cable (not illustrated) that allows the information it receives to be transmitted to a remotely-sited information processing module.

As can be seen in the figures, the connector 42 is enclosed at least partially in the second fluidtight closure piece 37 mentioned hereinabove.

In order to allow connection between the sensor head 39 and the connector 42, it is beneficial for the second fluidtight closure piece 37 to be adjacent to the fluidtight internal element 43 comprising the sensor head 39.

More specifically, the sensor head 39 projects from one side of the fluidtight internal element 43. The projecting part of the sensor head 39 is accommodated in the second fluidtight closure piece 37. In this way, the second fluidtight closure piece 37 at least partially comprises the connector 42 and the sensor head 39.

Between the sensor head 39 and the connector 42, the second fluidtight closure piece comprises a chamber 46.

The chamber 46 provides a space able to accommodate the connection pieces 80 of the sensor head 39 and of the connector 42, for example wires connecting the two elements.

Produced in this way, the cylinder incorporating the position sensor also protects the latter and the position sensor can easily be integrated into the elements of the cylinder.

It will be appreciated from the foregoing description how the cylinder according to the invention allows precise information regarding its operational status, and particularly regarding the stroke of the piston in the cylindrical housing 2 to be transmitted.

Such collected information is of great value to an operator who is able to anticipate a breakdown such as a seizure of the cylinder, a broken rod, a leak, etc.

Reference will now be made to a facility according to the invention and to a method for implementing such a facility.

Figure 5:
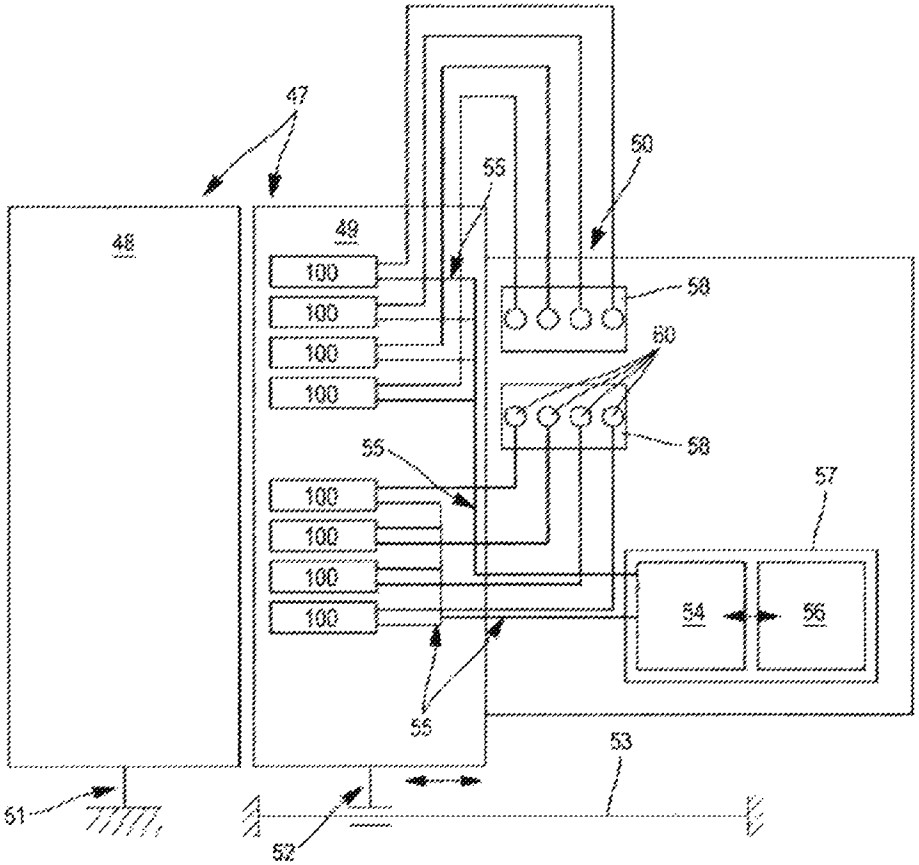
FIG. 5 is a schematic representation of a facility according to the invention.

FIG. 5 shows one example of a facility according to the invention, which comprises a mold 47 comprising two half-molds 48 and 49 which are mounted in a press 50. These elements are depicted very roughly here as blocks.

In the injection molding of plastic, there are various types of clamping press for closing a mold.

In the context of the example illustrated roughly here, the clamping press 50 is of the type comprising two platens 51 and 52, one 51 of the platens supporting the half-mold 48 and the other 52 of the platens supporting the other half-mold 49.

One 51 of the platens is fixed while the other platen 52 is mounted with the ability to move with respect to the first, to allow the mold to be opened and closed.

The mobile platen 52 is, as is known per se by those skilled in the art, mounted with the ability to slide along guide rods (illustrated symbolically by the element bearing the reference 53 in FIG. 5).

The press is preferably equipped with means for immobilizing the mobile platen in position (these means are not depicted), for example jaws that lock onto the guide rod or rods.

According to the invention, at least one of the two half-molds comprises at least one cylinder 100 like the one described and illustrated in FIGS. 1 to 4. In the context of our present example, the half-mold 49 mounted on the mobile platen 52 comprises eight cylinders 100.

It should however be appreciated that the invention is not restricted to the presence of a particular number of cylinders on a half-mold and that it extends to any facility that might comprise a mold comprising at least one cylinder 100.

The cylinders 100 that the mold 47 comprises are used for example for demolding the parts molded in the mold, or else for moving elements internal to the mold, either to facilitate demolding or to encourage the extraction of the molded parts.

According to the invention, the press 50 comprises a control module 54 which controls the operation of the mold 47 notably, for example, the travel of the mobile platen in order to open or close the mold.

Again according to the invention, each cylinder 100 communicates with the control module 54 and transmits to it information specific to its operational status. In concrete terms, the connectors 42 of each of the cylinders 100 are connected by a network of wires 55 to the control module so as to transmit the information specific to each cylinder 100 regarding the position of the piston in the sensor. In this way, the control module is constantly informed of the stroke of the cylinder at each instant T.

If the control module detects an anomaly (as will be seen later on) it can inform an operator of this: for example, if the cylinder always gives the same stroke information, during a predetermined lapse of time, then the control module may identify that there is a leakage problem or a broken cylinder rod problem, and above all, identify which cylinder is defective.

In order for the control module to indicate to an operator that a given cylinder is defective, the facility comprises a communication interface 56, for example a computer equipped with a screen and with a noise-emitting device.

The communication interface 56 is provided on the press 50 in the context of this exemplary embodiment, but could equally well be provided outside of the press 50, on a device external to the press and connected to the latter by any known means.

The communication interface 56 also comprises means allowing operating instructions to be transmitted to the control module: for example, the instructions may be to place the machine on standby or to move the mobile platen 52 in a particular way, etc. These instructions are given by an operator who controls the emission of these instructions via the communication interface.

The assembly formed by the communication interface and the control module forms the management interface 57 of the facility.

As was seen above, the cylinders 100 that the facility comprises may transmit indications regarding their stroke to the control module.

However, it can sometimes be that the problems are not identifiable from the strokes of the cylinders: certain problems are identifiable by monitoring the fluid pressures on which the cylinders 100 operate.

It should also be noted that the cylinders 100 may operate at different fluid pressures.

The facility according to the invention makes provision for installing, on the press, at least one bored unit 58 comprising at least two electrically-operated valves 59. In the context of this example, the pressure comprises two bored units 58 each comprising four electrically-operated valves 59.

Each cylinder 100 is connected to an electrically-operated valve 59. Thus, the cylinders 100 are connected in groups of four cylinders to a bored unit 58 comprising four electrically-operated valves.

Figure 6:
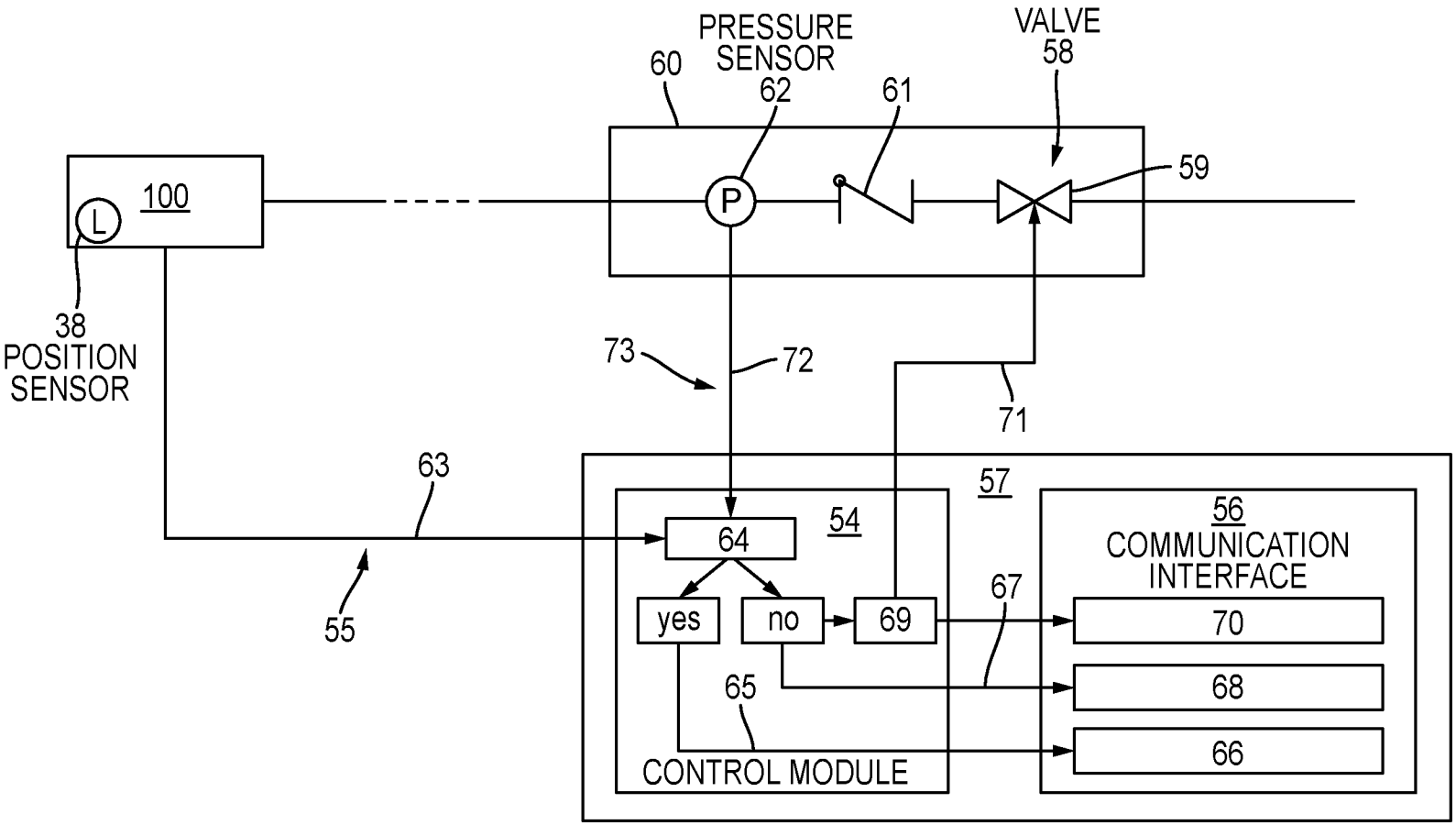
FIG. 6 is a diagram illustrating certain elements of the facility according to the invention and the interactions between these elements.

More specifically, as can be seen in FIG. 6, the bored unit comprises four sets of elements 60, each of the sets comprising an electrically-operated valve 59, a nonreturn valve 61 positioned downstream of the electrically-operated valve 59 and a pressure sensor 62, positioned downstream of the nonreturn valve 61.

As is shown in FIG. 6, the pressure sensor 62 communicates with the control module 54: for the circuit concerned, the pressure sensor 62 transmits information regarding the circuit pressure in real time or at predetermined intervals.

Thus, the control module is able to detect abnormal pressure information and inform the operator of this via the communication interface.

The control module may also command the opening of the electrically-operated valve 59 for a given circuit, so as to increase the pressure in a circuit and thus increase the pressure in a hydraulic cylinder 100.

Because the hydraulic cylinder 100 also communicates with the control module 54, transmitting information to it, the control module is able to transmit operating instructions to the electrically-operated valve 59 associated with the given circuit, in order for example to increase the pressure in the hydraulic cylinder and correct its stroke.

Reference will now be made to a method of operation specific to the invention, implemented in the facility that has just been described.

For this, reference will be made essentially to FIGS. 5 and 6.

The facility according to the invention operates according to a predetermined cycle of opening and closing the mold and of injecting material into the mold.

At any moment, the facility implements a method according to the invention aimed at continuously indicating to an operator whether the hydraulic cylinders have the correct operational status.

In order to do this, the following steps are performed: the position sensors 38 of each of the hydraulic cylinders 100 generate position information 63 (FIG. 6) which defines the position of the piston in the cylindrical internal housing 2 of the cylinder in which it is located. The position information 63 is therefore information regarding the stroke of the cylinder.

The position information 63 is transmitted via the network 55 to the control module. The network is a network of electrical conductors operating at a current of 4.2 mA.

Said control module 54 compares the position information 63 that it receives with reference position information communicated to it. This is the comparison step bearing the reference 64 in FIG. 6: for example, if the cylinder 100 must have a stroke of 300 mm in order to operate correctly, then the reference position information is 300 mm and the position information 63 it receives is compared against that.

There may be a tolerance to be applied in order for the control module to consider whether the position information 63 is compliant or non-compliant with the reference position information.

According to the comparison between the reference position information and the information it receives, the control module 54 generates two responses: either the position information 63 is compliant and the response generated is yes, or else the position information 63 is not compliant and the response generated is no.

If the response generated is yes, the control module transmits compliance information 65 to the communication interface 56 and this leads to the delivery, to the display screen of the interface 56, of a message 66 indicating to the operator that the cylinder is operating normally.

If the response generated is no, then the control module may act in at least two ways: first of all, it transmits non-compliance information 67 to the communication interface 56 and this leads to the delivery, to the display screen of the interface 56, of a message 68 indicating to the operator that the cylinder has a problem with operation. In parallel with this, the control module may analyze the nature of the non-compliance (the analysis step bears the reference 69) and generate instructions aimed at modifying the operation of the facility.

For example, according to the position information 63, it may deduce that the rod of the cylinder has broken, and order that the facility be made safe, leading to a spot shut-down thereof.

If the nature of the non-compliance is identified, it may also be indicated to the operator in the form of a message 70 on the communication interface.

For example again, the analysis of the position information 63 may indicate a problem of underpressure in the cylinder 100. In that case, the control module 54 may generate an operating instruction 71 for the set 60, aimed at opening the electrically-operated valve 59 in order to increase the internal pressure.

In parallel with this continuous monitoring of the cylinders, the facility according to the invention may implement a method aimed at monitoring other parameters.

According to the invention, the pressure sensor 62 of each set 60 (contained in the bored units 58) continuously generates pressure information 72 which it transmits to the control module 54 via a network 73 of cables operating at a current of 4.20 mA.

The control module 54 compares this pressure information with a pressure threshold value so as to identify whether or not the pressure detected conforms to the pressure that whichever cylinder fluid supply pipe should have.

This comparison step is also identified by the reference 64.

If this pressure value/information is normal, then the control module informs the operator of this by commanding the emitting of a normality message 66 on the communication interface 56: this then is a response 65 of the control module transmitted to the communication interface 56.

If that is not the case, then the control module 54 may:

generate a non-compliant response and transmit it to the communication interface which, in response, generates a message for the attention of an operator (written alert message, message in color, color that is displayed, etc.), and/or identify the nature of the noncompliance and act on the operation of the electrically-operated valve by commanding its opening, or act on the overall operation of the facility and trigger making it safe.

Thus, the control module can detect a leak, or even fatigue in the fluid-conveying (supply) pipe, or indeed a problem associated with the cylinder to which the supply pipe is connected.

The response of the communication interface for signaling a problem may also differ from or be in addition to a message displayed on a screen: the interface could emit a noise signal audibly enough to the operator to alert him to a problem and make him consult the communication interface screen.

It will be appreciated from the foregoing how the invention makes it possible to anticipate problems with the operation of the cylinders or other elements that a facility comprises, and how the cylinder according to the invention can be implemented in a method.

It should, however, be appreciated that the invention is not restricted to the embodiment described and illustrated hereinabove and that it extends to the implementation of any equivalent means.

The invention claimed is:

1. A hydraulic cylinder comprising:

a cylindrical housing having an internal cylindrical housing axis, in which a piston is mounted with the ability to move, said piston dividing said cylindrical housing into two chambers which are fluidtight and isolated with respect to one another, the cylindrical housing comprising at least two passages for introducing a fluid into or removing a fluid from each of the two chambers, first and second end walls, the first end wall partially closing one end of said cylindrical housing and the second end wall being opposite the first end wall and partially closing a second end of said cylindrical housing, a rigid rod, secured to the piston and coaxial with the cylindrical housing, said rigid rod passing through a first passage opening formed in the first end wall, said hydraulic cylinder comprising a position sensor comprising a sensor head, a sensor rod which is secured to the sensor head and around which a magnet is push-fitted, and a connector connected to said sensor head, the position sensor being arranged in the cylinder as follows:

the sensor head is at least partially located inside said housing and at least partially enclosed in a first fluidtight element internal to said cylindrical housing, said first fluidtight element forming an end stop for said piston;

said sensor rod is at least partially inserted in said rigid rod of said hydraulic cylinder, and the magnet is enclosed in said piston characterized in that the cylinder comprises a second fluidtight closure piece which closes a second opening formed in the second end wall and which is fixed at least partially to said second end wall of the cylinder, said connector is at least partially enclosed in said second fluidtight closure piece, and in that the second fluidtight closure piece being adjacent to the first fluidtight element that accommodates the sensor head, so as to allow the connector to be connected to the sensor head.

2. The cylinder as claimed in claim 1, characterized in that the sensor head is partially accommodated in the second fluidtight closure piece.

3. The hydraulic cylinder as claimed in claim 2, characterized in that the second fluidtight closure piece comprises a chamber positioned between the sensor head and the connector, said chamber (46) being able to accommodate connection pieces that connect the sensor head to said connector.

4. A facility for manufacturing at least one part injection-molded in at least one mold, said facility comprising:

at least one mold equipped with at least one cylinder, notably for at least partially ejecting a part molded in said mold, and at least one control module for controlling the operation of said mold, characterized in that said at least one cylinder is at least one hydraulic cylinder as claimed in claim 1, and in that said at least one hydraulic cylinder communicates with said at least one control module, transmitting to it information specific to its operational status.

5. The facility as claimed in claim 4, characterized in that the facility is equipped with at least one electrically-operated valve connected to a supply circuit supplying fluid to said at least one hydraulic cylinder, and in that said control module transmits operating instructions to said electrically-operated valve, in response to the information transmitted by said at least one hydraulic cylinder.

6. The facility as claimed in claim 5, characterized in that said facility comprises at least one pressure sensor positioned downstream of the electrically-operated valve, and in that said at least one pressure sensor communicates with said control module.

7. The facility as claimed in claim 4, characterized in that said at least one cylinder is more than two hydraulic cylinders 4, and in that the facility comprises at least one bored unit comprising at least two electrically-operated valves and at least two pressure sensors, each pressure sensor being associated with one electrically-operated valve, and each electrically-operated valve being associated with a respective one of the more than two hydraulic cylinder.

8. The facility as claimed in claim 4, characterized in that said control module is associated with a communication interface, said control module being able to transmit information to said communication interface, said information being transcribed to a screen intended for an operator.

9. The facility as claimed in claim 8, characterized in that said communication interface is able to receive and to transmit instructions to the control module in response to information transmitted by an operator.

10. A method for implementing a facility as claimed in claim 4, comprising the following steps:

a) the sensor of the hydraulic cylinder generates position information, b) said position information is transmitted to said control module, c) said control module compares said position information with reference position information and generates a hydraulic cylinder status response, e) said control module transmits said hydraulic cylinder status response to a communication interface, f) said communication interface transcribes said hydraulic cylinder status response so that it is intelligible to an operator, h) at least one pressure sensor generates pressure information, i) said at least one pressure sensor transmits said pressure information to said control module, j) said control module compares said pressure information with a pressure threshold value and generates a pressure-status response, k) Said control module transmits said pressure-status response to said communication interface, l) said communication interface transcribes said pressure-status response so that it is intelligible to an operator.

11. The method as claimed in claim 10, characterized in that, in parallel with step e), it implements the following step:

g) said control module transmits an operating instruction to an electrically-operated valve.

12. The method as claimed in claim 10, characterized in that, in parallel with step k), it implements the following step:

m) said control module transmits an operating instruction to an electrically-operated valve.

13. The method as claimed in claim 10, characterized in that the transcribing of said hydraulic cylinder status response or of said pressure status response by said communication interface is written information printed on a screen and/or an audible signal emitted by said interface and/or an element that displays on a screen in a predetermined color.

* * * * *